US007300304B1

(12) United States Patent
Takashita

(10) Patent No.: US 7,300,304 B1
(45) Date of Patent: Nov. 27, 2007

(54) FLAT CIRCUIT BOARD ELECTRICAL CONNECTOR

(75) Inventor: Yoshinori Takashita, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/706,277

(22) Filed: Feb. 15, 2007

(30) Foreign Application Priority Data

Mar. 24, 2006 (JP) ..... 2006-082432

(51) Int. Cl.
*H01R 12/24* (2006.01)

(52) U.S. Cl. ..... 439/495; 439/260

(58) Field of Classification Search ..... 439/67, 439/260, 492, 495, 496
See application file for complete search history.

(56) References Cited

U.S. PATENT DOCUMENTS

| | | | | |
|---|---|---|---|---|
| 6,338,648 | B1 * | 1/2002 | Miura et al. | 439/495 |
| 6,514,101 | B1 * | 2/2003 | Miura | 439/495 |
| 6,517,367 | B2 * | 2/2003 | Yamane | 439/260 |
| 6,726,497 | B2 * | 4/2004 | Nogawa et al. | 439/260 |
| 6,855,002 | B2 * | 2/2005 | Chiu | 439/495 |
| 2002/0045374 | A1 | 4/2002 | Kunishi et al. | |
| 2002/0115326 | A1 | 8/2002 | Yamane | |

FOREIGN PATENT DOCUMENTS

| | | |
|---|---|---|
| EP | 1049200 | 11/2000 |
| EP | 1148590 | 10/2001 |
| EP | 1150398 | 10/2001 |
| EP | 1696514 | 8/2006 |
| JP | 11-031561 | 2/1999 |
| JP | 11031561 | 2/1999 |

OTHER PUBLICATIONS

European Search Report Jul. 31, 2007.

* cited by examiner

*Primary Examiner*—Thanh-Tam Le
(74) *Attorney, Agent, or Firm*—Takeuchi & Kubotera, LLP

(57) ABSTRACT

A flat circuit board electrical connector includes a housing (20); a plurality of flat terminals supported having a pair of support sections (14, 16), a movable member (40) having a cam shaft (44), wherein when said movable member (40) is at said open position, said cam shaft (44) is inserted into a space between said support sections (14, 16); an engaging edge (16B) is provided at least one of said support sections (16) to engage with said cam shaft (44); a regulation metal fittings (30) provided in parallel with said terminals; a regulated island (45) provided on said movable member (40); a regulation arm (33) provided on said regulation metal fittings (30) to regulate said regulated island (45) of said movable member (40) such that said cam shaft (44) is engaged with said engaging edge (16B).

6 Claims, 4 Drawing Sheets

FLAT CIRCUIT BOARD ELECTRICAL CONNECTOR

BACKGROUND OF THE INVENTION

1. Field of the Invention

The present invention relates to flat circuit board electrical connectors.

2. Description of the Related Art

The conventional flat circuit boards include flexible print circuit (FPC) boards and flat cables. JP 11-031561 discloses an electrical connector for connecting such a flat circuit board to another circuit board or the like.

As shown in FIGS. 3 and 4, the electrical connector of the above reference includes a housing 52 and a plurality of flat terminals 51 supported by the housing 52. The terminal 51 has a substantially H-shaped form that has upper and lower arms linked at a midpoint such that the upper arm is able to swing at the midpoint. The upper arm has a support section 54A on the right side of the midpoint 53 and, on the left side, a contact section 54B with a contact projection 54C. The lower arm has a support section 55A on the right side of the midpoint 53 and, on the left side, a fixing section 55D with a projection 55C.

A channel 56 is provided in the housing 52 to receive the terminal 51 from the right side. All the channels 56 are communicated by left and right side openings 57 and 58 of the housing 52. A flat circuit board is inserted into a space between the contact sections 54B and the fixing sections 55D through the left side opening 57. A movable member 59 is supported in the right side opening 58 for rotation. The movable member 59A is made of an insulative material so as to have an operational section 59A, a shaft section 59B, and a pressure section 59C. The operational section 59A projects from the housing 52 through the right side opening 58. The shaft section 59B has a semi-circular cross-section and supported by the support section 55A of the lower arm. When the movable member 59 is turned clockwise to the closed position, the pressure section 59C pushes up the support section 54A of the terminal 51.

A pair of stud portions 59D extends outward from the opposite sides of the movable member 59 along the center line of the shaft section 59B. When the movable member 59 is rotated, the stud portions 59D are rotatably supported along with the shaft section 59B. A tapered indentation 61 and a stepped indentation 62 are provided in the inside of a side wall 60 of the housing, and a slit 64 is provided in a top wall 63 adjacent to another side wall 60, allowing the side wall 60 to flex outward. The movable member 59 is attached to the housing 52 from right side such that the stud portion 59 passes over the tapered indentation 61 and snaps in the stepped indentation 62, providing resistance to accidental separation.

In the connector of the above Patent reference, the stud portions snap in the stepped indentations to prevent separation of the movable member. When the number of terminals is large, however, the movable member becomes so wide that it becomes susceptible to warping under external forces, causing separation of the movable member, resulting in contact failure between the terminal and the flat circuit board.

SUMMARY OF THE INVENTION

Accordingly, it is an object of the invention to provide a flat circuit board electrical connector capable of preventing separation of the movable member for a large number of terminals.

According to the invention there is provided a flat circuit board electrical connector includes a housing; a plurality of flat terminals supported by the housing at regular intervals in a first direction perpendicular to the flat terminals and having a linking section, a pair of support arms linked by the linking section, and at least one contact arm extending from the linking arm in an opposite direction to the support arms, a movable member for increasing a contact pressure between the contact arm and a flat circuit board inserted into a contact position; a cam portion provided on the movable member between the support arms; the movable member movable between an open position where the movable member permits insertion of the flat circuit board and a closed position where the pressure contact is increased, wherein when the movable member is at the open position, the cam portion is able to be inserted into a space between the support arms; an engaging portion is provided at least one of the support arms to engage with the cam portion; a regulation metal fittings provided in parallel with the terminals; a regulated portion provided on the movable member at a position corresponding to the regulation metal fittings; a regulation arm provided on the regulation metal fittings to regulate the regulated portion of the movable member such that the cam portion is engaged with the engaging portion.

According to the invention, the cam portion and the regulated portion are in the same rotary axis and the terminals and the regulation metal fittings regulate the cam portion and the regulated portion from both sides so that the movable member does not shift from the engagement with the engaging portion, thus preventing separation of the movable member. The cam portion of the movable member is smaller than a distance between the support arms at the open position of the movable member and larger than the distance at the closed position so that not only the insertion is made easy but also a satisfactory pressure is applied to the flat circuit board at the closed position.

The engaging portion is formed as an engaging recess in the support arm. The cam portion is brought to the engaging recess and regulated by the regulated metal fittings, thus preventing from coming off from the engaging recess. The regulation arm extends along the other support arm of the terminal. The regulation metal fittings is inserted into the housing in the opposite direction to the terminals so that the regulation arm and the support arms are situated on opposite sides of the rotary axis. The regulation metal fittings has a fixing leg projecting from a bottom of the housing. The fixing leg is soldered to the flat circuit board, increasing the retention power of the connector to the circuit board.

According to the invention, the regulation metal fittings is added to the terminal arrangement such that both the terminals and the regulation metal fittings support and regulate the rotary center of the movable member so that the rotary section does not come off from the engaging portion upon accidental application of an external force. Even if there is a large number of terminals, a single regulation metal fittings is provided at a middle position to prevent separation without failure. The regulation metal fittings is made of the same metal sheet as the terminals so that the connector is enlarged only by the thickness of the regular metal fittings.

DESCRIPTION OF THE PREFERRED EMBODIMENTS

Figure 1:
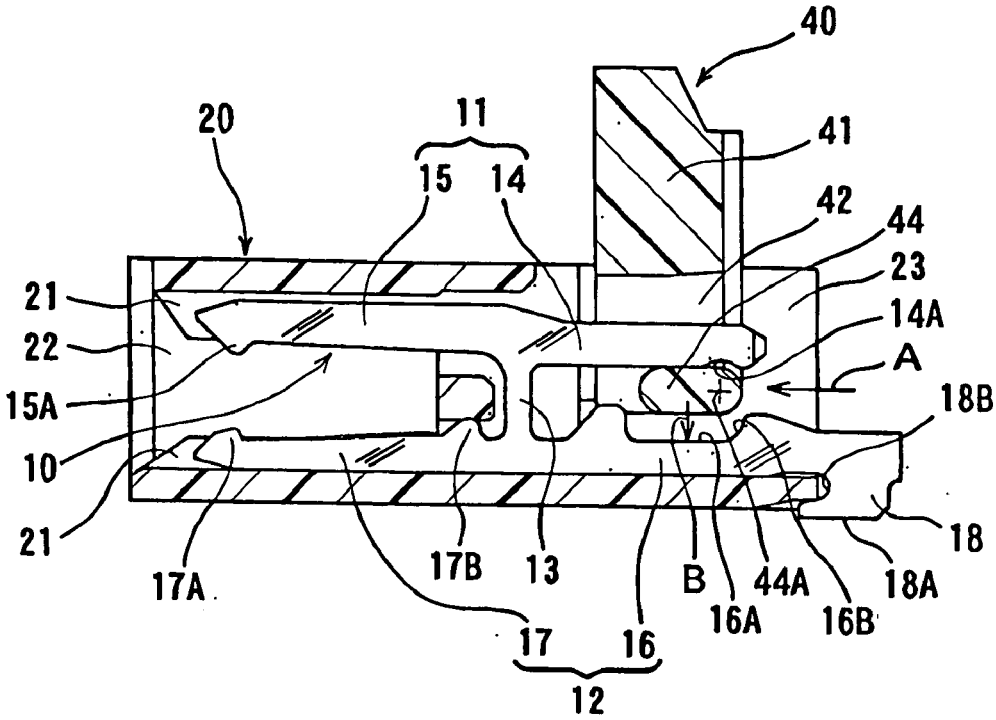
FIG. 1(A) is a sectional view taken at a terminal position of a connector where no regulation metal fittings is attached and a movable member is being assembled according to an embodiment of the invention.
FIG. 1(B) is a sectional view of the connector taken at the position where a regulation metal fittings is to be attached.
Figure 1:
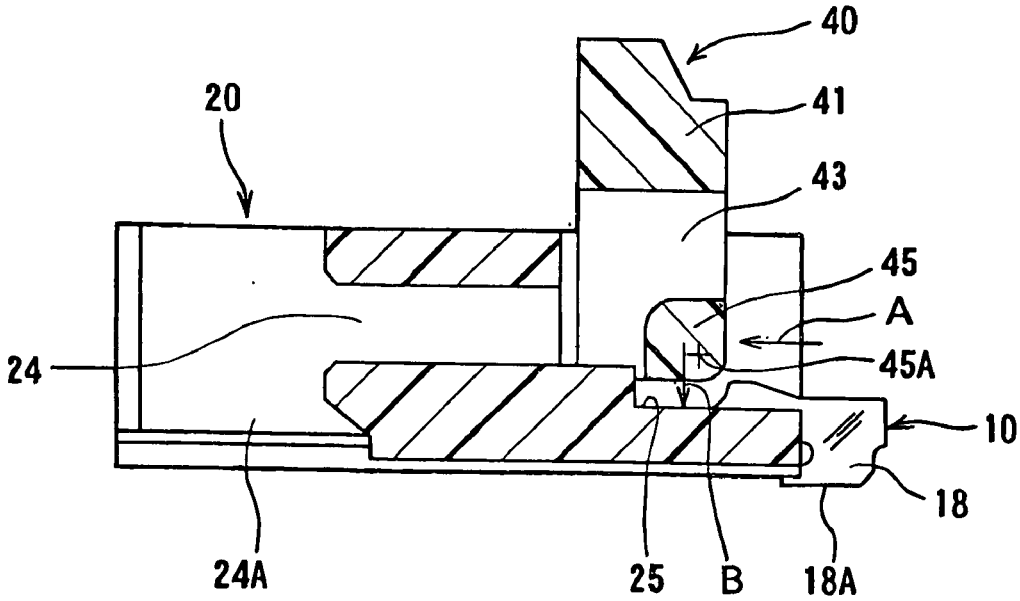

In FIG. 1(A), a housing 20 made of an insulative material supports a flat terminal 10. The flat terminal 10 is made by stamping a sheet metal so as to have a substantially H-shaped form that has parallel upper and lower arms 11 and 12 and a linking section 13 for linking them as a unit. The upper arm 11 has an upper support section 14 and an upper contact section 15 on right and left sides of the linking section 13. The lower arm 12 has a lower support section 16 and a lower contact section 17 on right and left sides of the linking section 13.

The upper support section 14 has a downward bearing recess 14A near the right side rear end and the upper contact section 15 has a downward contact projection 15A at the left side front end. The lower support section 16 has an upward recess 16A from which a connection section 18 extends to the right beyond the housing 20. The upward recess 16A has an arc-shaped engaging edge 16B on the right side which is opposed to the bearing recess 14A of the upper support section 14. The width of the upward recess 16A is made slightly greater than the distance between the engaging edge 16B and the bearing recess 14A. The connection section 18 project from the housing 20 and extends downward slightly beyond the bottom surface of the housing 20 so that the lower edge 18A of the connection section 18 comes to contact with the corresponding circuit section of a circuit board for soldering. An attaching recess 18B is provided on the connection section 18 to receive the bottom end of the housing 20. The lower contact section 17 has an upward contact projection 17A at its front end and an upward fixing projection 17B near the linking section 13.

A plurality of the terminals 10 are press fitted in terminal slots 21 provided in the housing 20 at regular intervals in the direction perpendicular to the drawing sheet. The terminal slots 21 communicate with each other on the left and right sides to form left and right openings 22 and 23. The left opening 22 receives a flat circuit board between the upper and lower contact sections 15 and 17 while the right opening 23 receives the upper support section 14 and a portion of the movable member 20.

As shown in FIG. 1(B), a metal-fittings slot 24 is provided in the housing 20 outside the outermost terminal 10 for receiving metal fittings. The metal-fittings slot 24 communicates with the left and right openings 22 and 23. A cutout portion 24A is provided in the left bottom wall of the housing 20 for allowing metal fittings to enter the housing 20. A step-down portion 25 is provided on the bottom wall of the housing 20 at a position corresponding to the right opening 23. The step-down portion 25 is formed in the range including the support recess 16A of the lower support section 16.

Figure 2:
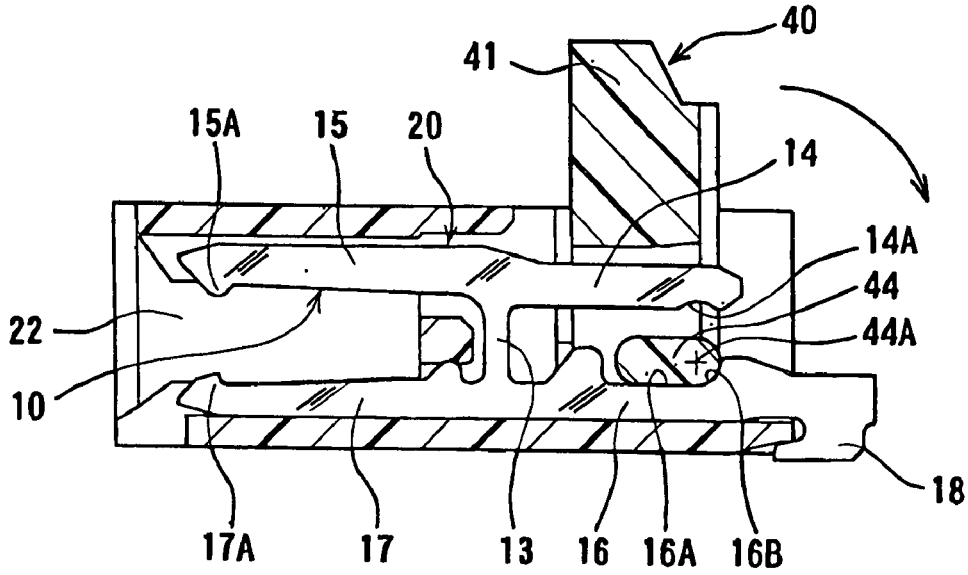
FIG. 2(A) is a sectional view taken at the terminal position of the connector where a regulation metal fittings has been attached and the movable member is at the open position.
FIG. 2(B) is a sectional view taken at the regulation metal fittings.
Figure 2:
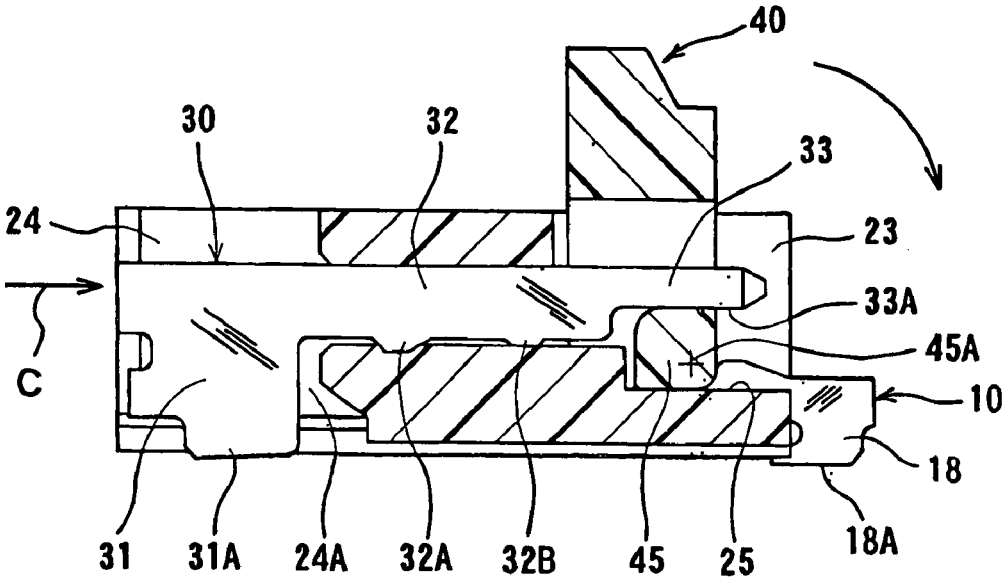
Figure 3:
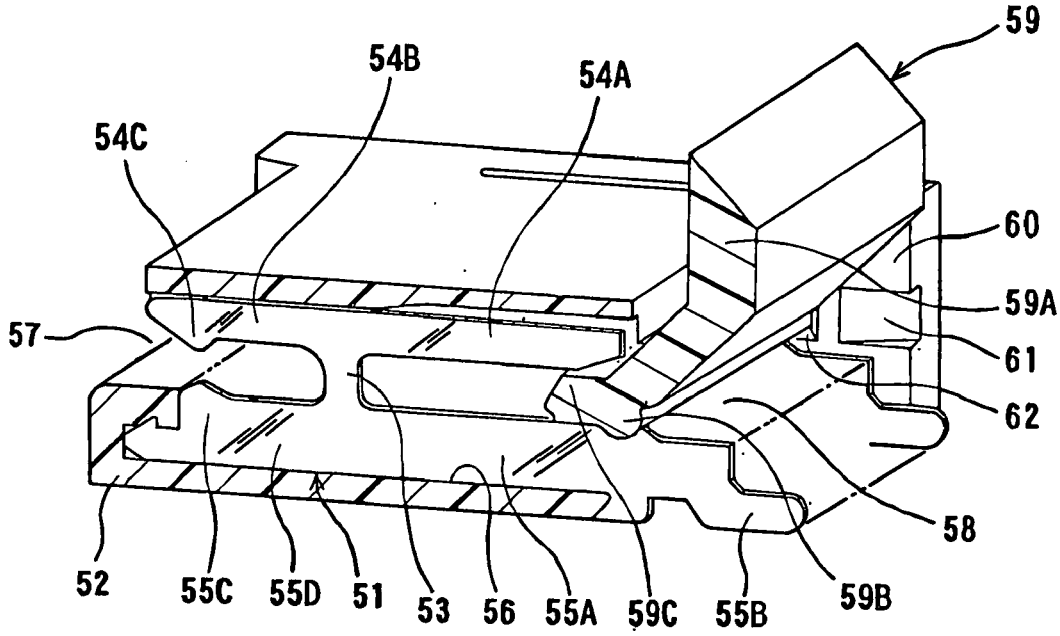
FIG. 3 PRIOR ART
FIG. 3 is a perspective sectional view of a conventional connector.
Figure 4:
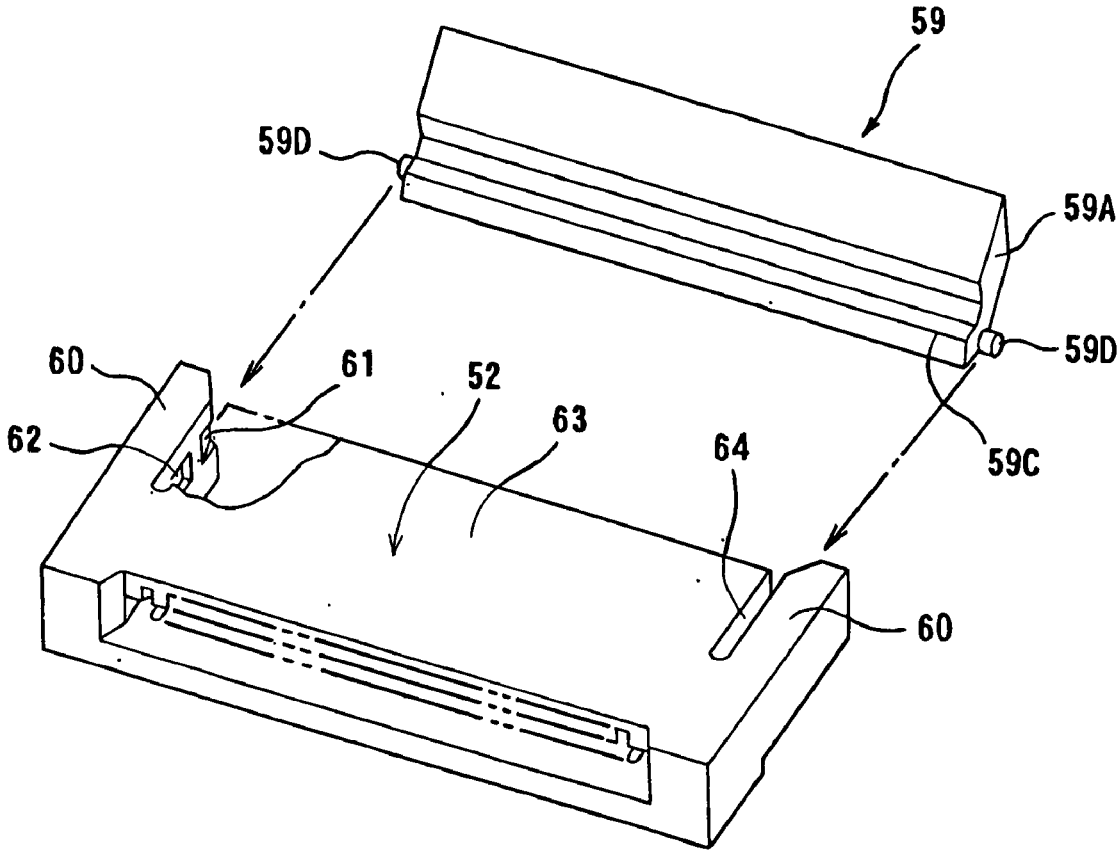
FIG. 4 PRIOR ART
FIG. 4 is a perspective view of the connector of FIG. 4.

As shown in FIG. 2(*b*), a regular metal fittings 30 is inserted into the metal-fitting slot 24 of the housing 20 from left or in the opposite direction that the terminal 10 is inserted. This flat regular metal fittings 30 is made by stamping so as to have a base section 31, a fixing arm 32, and a regulation arm 33. The base section 31 extends downward through the cutout portion 24A and project slightly from the housing 20, forming a fixing leg 31A.

The fixing arm 32 has engaging projections 32A and 32B on its lower edge so that when it is press fitted, the engaging projections 32A and 32B cut into the bottom wall of the housing 20 for preventing the metal fittings 30 to come off. The regulation arm 33 is narrower than the fixing arm 32 and extends into the right opening 23 to the position almost the same position of the upper support section 14 of the terminal 10 as viewed in the direction perpendicular to the drawing sheet. Also, the lower edge 33A of the regulation arm 33 is level with the lower edge of the upper support section 14.

The movable member 40 is made of an insulative material so as to serve as a lever. It has a lower section placed in the right opening 23 of the housing 20 and an upper section or operation section 41 that projects upward from the housing 20 at the open position. Slots 42 and 43 are provided in the lower section of the movable member 40 at positions corresponding to the terminal slots 21 and metal fittings slot 24, respectively, to receive the upper support arm 14 of the terminal 10 and the regulation arm 33 of the regulating metal fittings 30, respectively. A cam shaft 44 and a regulated island 45 are provided in the lower right corners of the slots 42 and 43, respectively. Rotation centers 44A and 45A are provided at the same positions in the cam shaft 44 and the regulated island 45, respectively.

As shown in FIG. 1(A), the cam island 44 has an elongated circular cross-section, with the right side arc having a radius substantially equal to that of the engaging edge 16B of the lower support arm 16 and the left side arc having a radius substantially equal to that of the bearing recess 14A of the upper support arm 14. In this embodiment, the radius of these four arcs are substantially equal. The height of the cam island 44 is less than the space between the straight lower edge of the upper support arm 14 and the upper edge of the engaging edge 16B of the lower support arm 16 so that the cam island 44 can enter in the space between the upper support arm 14 and the lower support arm 16 in the A direction. The width of the cam island 44 is greater than the distance between the bearing recess 14A of the upper support arm 14 and the engaging edge 16B of the lower support arm 16 so that when the movable member is turned into the closed position, the cam island 44 pushes up the upper support arm 14 for warping or flexing.

The regulated island 45 has a substantially square cross-section with upper left and lower right rounded corners. As shown in FIG. 2(B), the height and width of the regulated island 45 are substantially equal to the distance between the lower edge 33A of the regulation arm 33 and the step-down section 25 of the housing 20 so that when the island 45 is rotated, the upper left rounded corner makes the rotation smooth and, at any rotation angle, the lower edge 33A of the regulation arm 33 is in contact with or adjacent to the regulated island 45. The upper right and lower left corners are not rounded so as to work as a stopper to stop the rotation beyond a predetermined angle.

The connector is assembled and used as follows.

(1) As shown in FIG. 1(A), a plurality of terminals 10 are inserted into the terminal slots 21 of the housing 20 through the right opening 23. The fixing projection 17B of the lower contact arm 17 cuts into the fixing portion of the housing and the attaching recess 18B of the connection section 18 is fitted over the bottom wall of the housing 20 to keep the terminal 10 in place.

(2) Then, the movable member 40 is assembled as shown in FIG. 1(A) by moving the cam island 44 into a space between the upper support arm 14 and the lower support arm 16 in the right opening 23 in the A direction. At this point, as shown in FIG. 1(B), the regulated island 45 is moved in the A direction.

(3) In FIGS. 1(A) and (B), the cam island 44 and the regulated island 45 are at upward positions. Then, the cam island 44 and the regulated island 45 are moved downward in the B direction such that the cam island 44 is received by the receiving recess 16A of the terminal 10, with its lower right portion engaging with the engaging edge 16B, while the regulated island 45 abuts on the step-down section 25 of the housing 20. Since the cam island 44 engages with the engaging edge 16B, the movable member 40 is preventing from coming off in the right direction. However, if the cam island 44 and the regulated island 45 can be lifted up in the B direction, the movable member 40 can be pulled off in the reversed A direction without difficulty.

(4) As shown in FIG. 2(B), after the cam island 44 and the regulated island 45 are moved downward, the regulation metal fittings 30 is inserted into the metal fitting slot 24 through the left opening 22 in the C direction such that the base section 31 is situated in the left opening 22, with the fixing leg 31A projects downward from the housing 20. The fixing arm 32 is press fitted into a space between the upper and lower walls of the housing 20 such that the engaging projections 32A and 32B cut into the lower wall to prevent separation of the regulating metal fittings 30. The lower edge 33A of the regulation arm 33 is in contact with or adjacent to the upper edge of the regulated island 45 of the movable member 40, thus preventing the regulated island 45 from being lifted up. Consequently, the movable member 40 does not come off from the housing, completing the assembling of the connector.

(5) Then, the connector is attached to a circuit board by soldering the lower edge 18A of the connection section 18 and the fixing leg 31A of the regulation metal fittings 30 before a flat circuit board, such as a flexible circuit board, is connected.

(6) Finally, the flat circuit board is inserted into a space between the upper and lower contact arms 15 and 17 through the left opening 22 and, then, the movable member 40 is turned to the closed position such that the cam island 44 is guided by the engaging edge 16B of the terminal 10 so as to lift up the upper support arm 14 while the regulated island is guided by the regulation arm 33 and the step-down section 25 of the housing 20. Consequently, the upper support arm 15 is flexed downward at the linking section 13, thus pressing with the contact portion 15A the flat circuit board against the contact portion 17A of the lower contact arm 17. As a result, the flat circuit board is brought into contact with the terminal 10 via at least one of the contact portions 15A and 17A and electrically connected to the circuit board.

The present invention is not limited to the embodiment illustrated in FIGS. 1 and 2 and a variety of its modifications are possible.

For example, the regulation arm of a regulation metal fittings may be spaced from the regulated island to such an extent that the cam island does not come off from the engaging edge. The cam island may take an eccentric circular cam form. The regulation metal fittings may be moved up or down after lateral insertion to fit into a slot of the housing. The regulation metal fittings may be bent in part for improving the strength. The regulation metal fittings may be provided in the range of arranging terminals.

The invention claimed is:

1. A flat circuit board electrical connector, comprising:

a housing;

a terminal supported by said housing at regular intervals in a first direction perpendicular to said terminal and having a linking section, a pair of support sections linked by said linking section, and at least one contact section extending from said linking section in an opposite direction to said support sections, a movable member for increasing a contact pressure between said contact section and a flat circuit board inserted into a contact position;

a cam shaft provided on said movable member between said support sections;

said movable member movable between an open position where said movable member permits insertion of said flat circuit board and a closed position where said contact pressure is increased, wherein when said movable member is at said open position, said cam shaft is able to be inserted into a space between said support sections;

an engaging edge is provided at least one of said support sections to engage with said cam shaft;

a regulation metal fitting provided in parallel with said terminal;

a regulated island provided on said movable member at a position corresponding to said regulation metal fitting; and a regulation arm provided on said regulation metal fitting to regulate said regulated island of said movable member such that said cam shaft is engaged with said engaging edge.

2. The flat circuit board electrical connector according to claim 1, wherein said cam shaft of said movable member is smaller than a distance between said support sections at said open position of said movable member and larger than said distance at said closed position.

3. The flat circuit board electrical connector according to claim 1, wherein said engaging edge is formed as an engaging recess in said support section.

4. The flat circuit board electrical connector according to claim 1, wherein said regulation arm extends along the other support section of said terminal.

5. The flat circuit board electrical connector according to claim 1, wherein said regulation metal fittings has a fixing leg projecting from a bottom of said housing.

6. The flat circuit board electrical connector according to claim 4, wherein said regulation metal fittings has a fixing leg projecting from a bottom of said housing.

* * * * *